US007152843B2

(12) United States Patent
Ward et al.

(10) Patent No.: US 7,152,843 B2
(45) Date of Patent: Dec. 26, 2006

(54) GRIPPING RIBS FASTENING SYSTEM FOR CONCRETE FORMING PANELS

(75) Inventors: Philip T. Ward, Leawood, KS (US); Roman Brewka, St. Joseph, MO (US)

(73) Assignee: Western Forms, Inc., Kansas, MO (US)

( * ) Notice: Subject to any disclaimer, the term of this patent is extended or adjusted under 35 U.S.C. 154(b) by 148 days.

(21) Appl. No.: 10/936,322

(22) Filed: Sep. 8, 2004

(65) Prior Publication Data

US 2005/0028472 A1 Feb. 10, 2005

Related U.S. Application Data

(62) Division of application No. 10/360,400, filed on Feb. 7, 2003, now Pat. No. 6,935,607.

(60) Provisional application No. 60/420,805, filed on Oct. 23, 2002.

(51) Int. Cl.
*E04G 17/065* (2006.01)
*E04G 9/02* (2006.01)

(52) U.S. Cl. ..... 249/216; 249/40

(58) Field of Classification Search ..... 249/40, 249/43, 190, 213, 216
See application file for complete search history.

(56) References Cited

U.S. PATENT DOCUMENTS

| | | | | |
|---|---|---|---|---|
| 929,470 | A | | 7/1909 | Neil |
| 954,636 | A | | 4/1910 | Kuman |
| 1,206,598 | A | | 11/1916 | Sager |
| 2,200,227 | A | * | 5/1940 | Olson ..... 52/364 |
| 2,838,592 | A | * | 6/1958 | Feketics ..... 52/463 |
| 3,801,061 | A | | 4/1974 | Holt |
| 4,147,322 | A | | 4/1979 | Dahlstrom |
| 5,761,874 | A | | 6/1998 | Hayakawa |
| 5,836,126 | A | | 11/1998 | Harkenrider et al. |
| 5,895,188 | A | | 4/1999 | Cheng |
| 5,922,236 | A | | 7/1999 | Zuhl |
| 6,016,632 | A | * | 1/2000 | McGee et al. ..... 52/733.2 |
| 6,209,275 | B1 | * | 4/2001 | Cates et al. ..... 52/762 |
| 6,615,556 | B1 | * | 9/2003 | Cates et al. ..... 52/731.9 |
| 2001/0007186 | A1 | * | 7/2001 | Cates et al. ..... 52/762 |
| 2003/0024179 | A1 | * | 2/2003 | Cates et al. ..... 52/204.1 |

OTHER PUBLICATIONS

Western Forms, Inc. Catalog titled "World's Leading Innovator in Aluminum Forming Systems" copyright 1999, all pages.

* cited by examiner

*Primary Examiner*—Michael Safavi
(74) *Attorney, Agent, or Firm*—Hovey Williams LLP

(57) ABSTRACT

A forming panel is provided which includes at least one and preferably a number of elongated channels each having inwardly projecting ribs which permit threadable attachment of hardward components such as bolts, externally threaded rings, collars and the like directly to the channel along an infinite number of locations. The channels may be parallel to one another, perpendicular to one another, or both. The forming panel may be used with other forming panels and are configured to receive therethrough anchoring members such as anchor bolts and tie rods which pass into the gap between opposed forming walls where concrete is poured. The forming panels may be used as cap forms whereby after the concrete is cured, forming panels below the cap form may be replaced and reattached above the cap form.

4 Claims, 6 Drawing Sheets

GRIPPING RIBS FASTENING SYSTEM FOR CONCRETE FORMING PANELS

RELATED APPLICATION

This application is a division of prior U.S. patent application Ser. No. 10/360,400 filed Feb. 7, 2003, now U.S. Pat. No. 6,935,607 which claims priority from U.S. Provisional Application No. 60/420,805, filed Oct. 23, 2002, said provisional application being hereby incorporated by reference into the present specification.

BACKGROUND OF THE INVENTION

1. Field of the Invention

This invention broadly concerns forming panels used in casting cementations materials such as concrete in the building construction field. More particularly, it is concerned with a forming panel having a channel which includes a threaded slot provided on the side of the panel facing away from the cementatious material which permits attachment of various members to the form, such as form hardware ties used for holding opposing panels in a fixed relationship during pouring and curing of the concrete and for attachment of other accessories such as braces, brackets for walers, saddles and the like, scaffolding, and plugs.

2. Description of the Prior Art

Forming panels are well known in the construction industry as providing a system for retaining flowable cementatious material such as concrete in a desired shape during pouring and curing. Forming panels of metal represent a significant advance over panels of wood because of their durability which permits their removal and reuse on successive construction projects. One typical use of such forming panels is the formation of upright walls including foundation walls, above-grade walls, parapet walls and the like.

Such metal forms are typically modular in character such that a number of panels are coupled together to providing a forming system. Such forming systems are generally shown and described in U.S. Pat. Nos. 4,708,315, 4,744,541, 4,958,800, 4,976,401, 4,978,099, 5,058,855, 5,080,321, 5,174,909, 5,184,439, 5,288,051, and 5,965,053, the disclosures of which are incorporated herein by reference. Prior forming systems and their panels included openings or channels which permitted attachment of accessories, such as shown in U.S. Pat. No. 5,965,053. However, those channels required the use of complementary nuts and bolts, clamps or pins with retainers to enable attachment of hardware and accessories such as tie bars, tie rods, braces, stiffbacks, supports and other forming accessories. Such loose parts are problematic at a construction site, being broken, misplaced or lost as the forming walls are disassembled or moved. Moreover, the location for receipt of these attachment members were limited and by necessity often were between reinforced areas of the forming panels and thus placed stress on portions of the panels in locations least configured to accept such stresses and strains.

SUMMARY OF THE INVENTION

The present invention presents a significant advance over prior art forming panels in that the back side of the panel is provided with an elongated channel extending along at least a part of the back side of the form, wherein the channel includes a slot having threads formed therein. The channel is preferably extruded and may extend in a substantially horizontal, vertical, or angular direction between horizontal and vertical, and several such channels can be provided on a single forming panel. The provision of a channel which is open to the rear represents a substantial improvement in that various accessories may be positioned along the slot and then tightened in the desired location. Not only may multiple accessories be mounted on the panel, or even a single channel, but further the provision of the threaded slot enables significant ability to adjust the desired position of the accessories and avoids the necessity of keeping nuts or similar loose threaded fasteners at the work site. Use of the threaded slot which is integral with the forming panel is especially advantageous for the construction worker who need not hold a nut in position using a tool while coupling a threaded fastener thereto. The elimination of such small nuts which are difficult to handle and hold in inclement weather not only increases worker comfort but also efficiency in assembling and disassembling a forming system. The provision of a threaded slot also permits all of the accessories to be configured with the same thread pattern and pitch. Furthermore, the threaded slot reinforces the face plate of the panel, such that stress and strain caused by the attachment of tie rods and the like at locations interior to the perimeter of the panel is carried by the frame including the channel rather than by the face panel.

Broadly speaking, the forming panel of the present invention includes a face panel and a frame for supporting the face panel. The frame includes at least one channel positioned on the rear face of the face panel opposite to the cementations material-receiving side thereof. The channel, preferably though not necessarily unitary in construction, includes an elongated slot therein which is threaded. As used herein in connection with a slot in a channel, the term "threaded" refers to the presence of opposed ridges or flights on the opposing, inward-facing sides of the wall surfaces of the channel forming the slot to permit a threaded member such as a bolt, stud, tie-rod or the like to advance into and be withdrawn from the slot when rotated. Because the slot is open at the ends, an encircling opening with internal threads as typically understood by the term "threaded" is not provided, but the ridges on the channel nonetheless permit threadable attachment of such threaded members. Preferably, the channel includes at least a pair of wall surfaces each having a plurality of ribs which cooperatively define a threaded surface in the slot. The channel is preferably formed by extrusion whereby the threaded slot extends longitudinally along the channel permitting the positioning of a complementary threaded member, such as a bolt, receiver or plug, to be capable of infinite adjustment along the threaded portion of the channel. The threaded slot further preferably extends substantially the entire length of the channel. Multiple channels may be included in the frame in parallel or transverse orientations. For example, a first set of one or a plurality of channels may be oriented in an upright position when the panel is positioned for use, and another set of channels may be positioned in horizontal relationship. The channels not only serve to provide a grid for multiple attachment locations for accessories to the panel, but also help to reinforce the face panel against deflection. Both the face panel and the frame may be provided of aluminum alloy or other suitable metal which is durable and capable of outdoor use. The channel may also have external serrations to facilitate gripping of the channel by clamps or other accessories.

The threaded slot provided by the channel may be used to anchor various types of accessories to the panel. For example, the face plate may be provided with a hole thereon to permit a threaded tie rod to pass through a hole in the face plate and into the slot. A receiver may then be threaded into the threaded slot for engaging and supporting the tie rod and inhibiting the passage of water or concrete through the hole and past the tie rod which may result in a rough and uneven concrete finish around the tie rod. The channel may also permit a large attachment nut to bear against the back side of the channel and thread onto the threaded end of the tie rod. Bolts or similar threaded fasteners may be readily threaded directly into the channel to attach braces, stiff-backs, or the like. In addition, a bolt may be threaded into the threaded slot and extend past the channel and through an opening in the face plate for anchoring into the concrete either before or after curing. Such a usage may be desirable for providing an anchor in the cured concrete whereby a plurality of sequential concrete pours may be employed to construct a multistory wall of sequentially poured wall sections by removing a panel from a completed wall and reinstalling the panel atop a cap or the like for providing a second, third or further walls after the poured concrete or other cementatious material of the lower wall has cured to hardness. The bolt and cap may then be withdrawn and reused for each successive wall section to be poured.

The forming panel hereof is useful as part of a forming system wherein a plurality of such panels may be connected by fasteners to provide a forming wall which faces another, opposite one of the forming walls to receive poured cementatious material therebetween. The threaded slots of the channels greatly facilitate the attachment and securement of tie rods at multiple locations internal to the surrounding edges of the form and the mounting of hardware and accessories such as an expandable wall brace, a horizontal waler, a scaffold bracket, a lifting bracket with a clevis, and a gang leveler without the need for small nuts which must be positioned in narrow channel slots. Rather, the bolts for coupling such members to the panel may be secured directly to the panel and threaded into the channels while retaining the capability of infinite adjustment along the threaded portion of the panel.

These and other advantages will be readily apparent to those skilled in the art with reference to the drawings and description which follow.

DESCRIPTION OF THE PREFERRED EMBODIMENT

Figure 1:
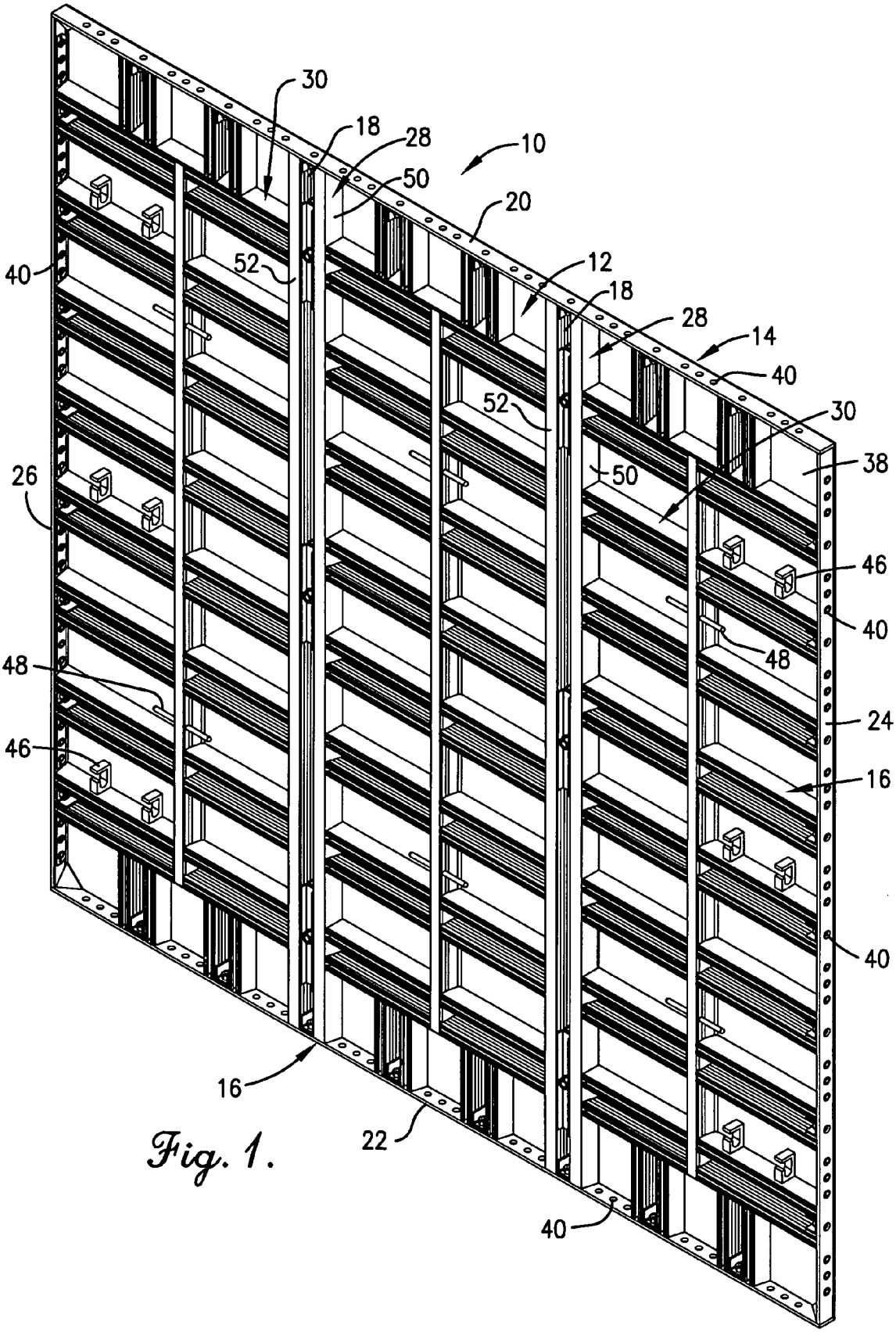
FIG. 1 is a left rear perspective view of the forming panel in accordance with the present invention wherein the frame of the forming panel includes channels having threaded slots open to the rear of the panel extending both in upright and transverse orientation.

Referring now to the drawings, a forming panel 10 in accordance with the present invention broadly includes a face plate 12 and a frame 14 and includes at least one channel 16 having an elongated, internally threaded slot 18. The forming panel 10 is preferably of aluminum or an aluminum alloy. The frame 14 preferably includes upper rail 20, lower rail 22 and side rails 24 and 26. The face plate 12, at least one of the channels 16 and two of the rails which are oriented to be generally parallel to the one of the channels 16 are preferably formed by extruding in a unitary or integral member.

Most preferably all of the channels 16 oriented in generally parallel alignment with respect to one another may be extruded with the face plate 12 and the two rails, with the channels 16 oriented at an angle thereto extruded separately and attached to the face plate 12 and the rails by welding. For example as shown in FIG. 1, a plurality of upright channels 28, the side rails 24 and 26 and the face plate 12 would be extruded, with the horizontal channels 30 separately extruded and, along with the upper rail 20 and the lower rail 22, welded in separate operation to the extruded member including the face plate 12.

In the cap form embodiment of the forming panel 10A shown in FIGS. 5, 6, 7 and 8 where a single channel 16A is provided as a horizontal channel, the face plate 12A, the horizontal channel 16A, the upper rail 20A, and the lower rail 22A would be extruded, with the side rails 24A and 26A welded thereto. The orientation of the members described herein are with reference to the drawings only, it being understood that the forming panels 10 and 10A may be used in different orientations on the job site.

In greater detail, the face plate 12 of the forming panel 10 shown herein is preferably of a relatively thin extruded sheet of aluminum which may be cut or pierced to provide a hole 32 therein for the passage of members to extending into the poured concrete 34. The face plate 12 includes a front face 36 and a rear face 38, the front face being smooth or textured, as desired, to provide a surface against which the poured concrete cures in the desired configuration.

The rails 20, 22, 24, and 26 extend rearwardly from the face plate 12 and are preferably welded together at their junctions forming corners of the forming panel 10, and a plurality of openings 40 are preferably provided in each in order to receive connectors such as pins 42 held by wedges 44 and the like for coupling the forming panel 10 to adjacent panels or other forming hardware, as shown in FIGS. 5, 6, 7 and 8. Hangers 46 for tie rods and the like and attachment pins 48 useful for lifting and moving the forming panels 10 may be located at suitable locations on the rear side of forming panel 10 as shown in FIG. 1 to provide access thereto during use, and additional reinforcements may be fastened, extruded or welded to the frame or the face plate in addition to the channels 16 as shown in FIG. 1.

As shown in FIG. 1, the channels 16 may be positioned at convenient locations and open to the rear side of the forming panel 10. Preferably, the channels 16 do not extend rearwardly beyond the rear edge of the rails. The channels 16 each include at least a first wall 50 and a second wall 52 which extend rearwardly from the face panel 12 and longitudinally therealong, the walls 50 and 52 being generally parallel to one another to provide threaded slot 18 therebetween. The walls 50 and 52 have respective opposing wall surfaces 54 and 56 each having a plurality of longitudinally extending ribs 58 which are parallel to one another and transversely spaced, preferably equidistant from one another as shown in the drawing figures to define the pitch of the thread.

The ribs 58 of one wall surface 54 are transversely positioned relative to the ribs 58 of the other wall surface 56 so as to permit threading of a threaded member 60 in the slot 18. For a typical threaded member, such as a bolt or the like, the ribs of the one wall surface 54 will be offset and alternate with the ribs 58 of the other wall surface 56 to accommodate the threads of the threaded member. The channels 16 may be upright channels 28 or horizontal channels 30, or placed in other orientations such as diagonally if desired. The provision of a plurality of upright channels 28 and horizontal channels 30 not only provides the user with a large number of opportunities to select for attachment of threaded members, but also provides substantial reinforcement to the face panel 12 to resist deflection caused by the weight of the concrete thereagainst.

The threaded slot 18 is adapted to threadably receive different threaded members 60 and thereby couple with a variety of different forming accessories such as, for example, tie rods 62. In particularly preferred embodiments, the channels 16 permit attachment of other components by having exterior slots 64 adapted to receive bolt heads for coupling strongbacks, beams or other members through the use of conventional bolts and nuts as illustrated in the embodiment shown in FIG. 4. Various uses of the forming panels 10 are illustrated in the drawing FIGS. 1–9.

Figure 2:
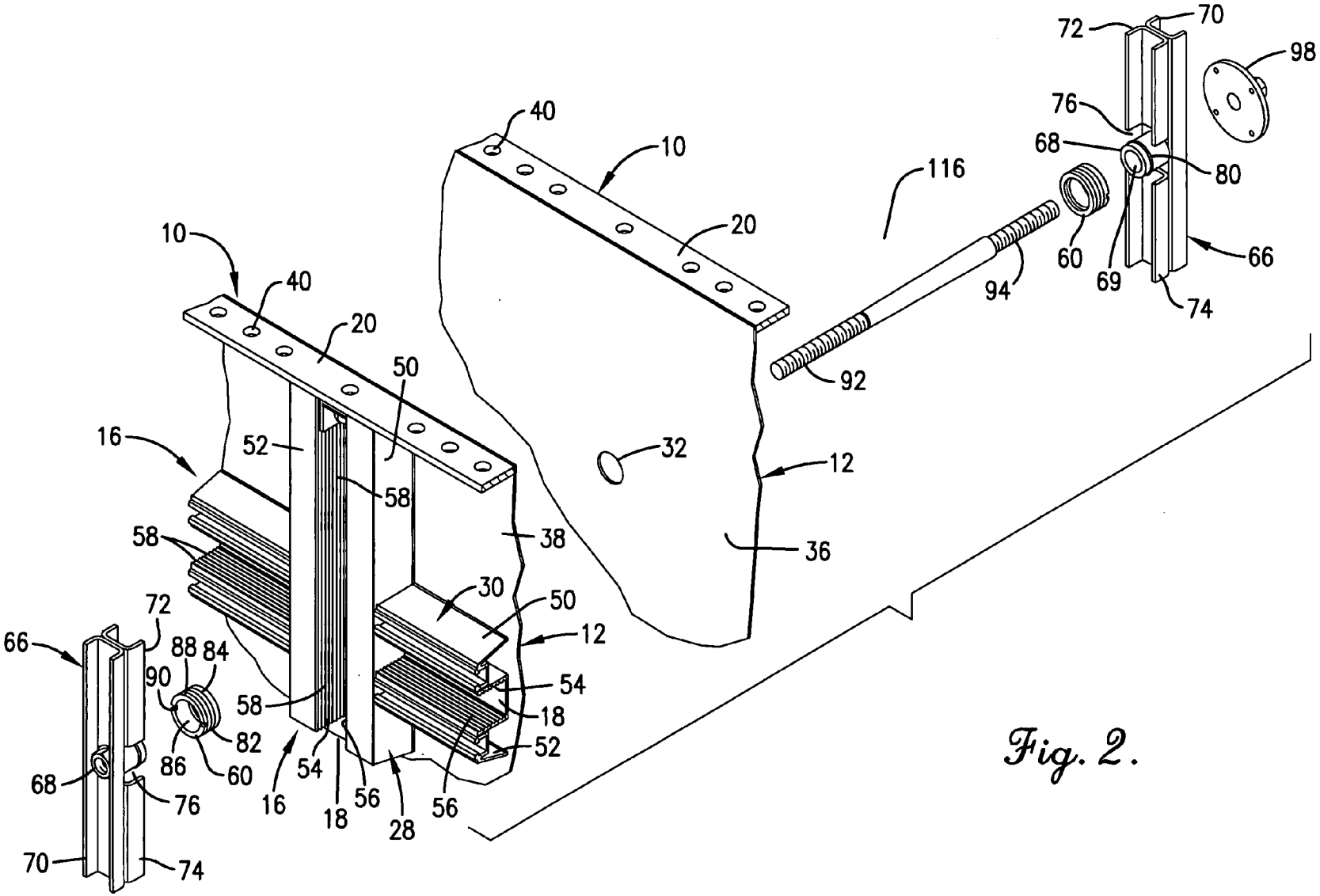
FIG. 2 is a fragmentary exploded view of a forming system including two opposed forming panels as shown in FIG. 1 opposed to one another and connected by a tie rod showing the use of filler inserts, a nut, a plate and externally threaded retaining rings for coupling the filler inserts and tie rod to the opposed forming panels.
Figure 3:
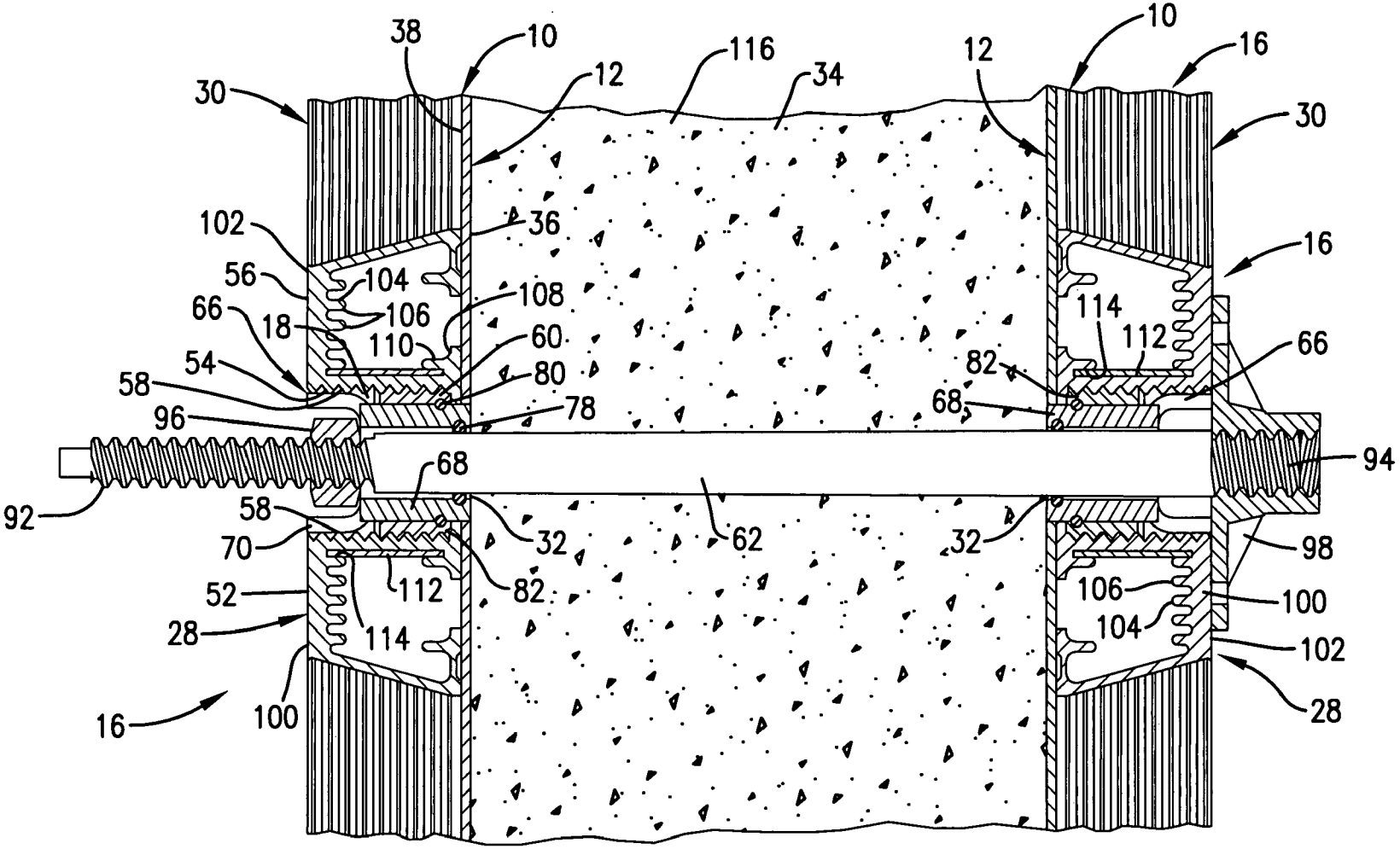
FIG. 3 is a fragmentary horizontal cross-sectional view of the forming system of FIG. 2 showing an upright channel in section with a tie rod passing through openings in the face plates of each opposed forming panel and the rings around bushings in filler inserts threaded into the slots.
Figure 4:
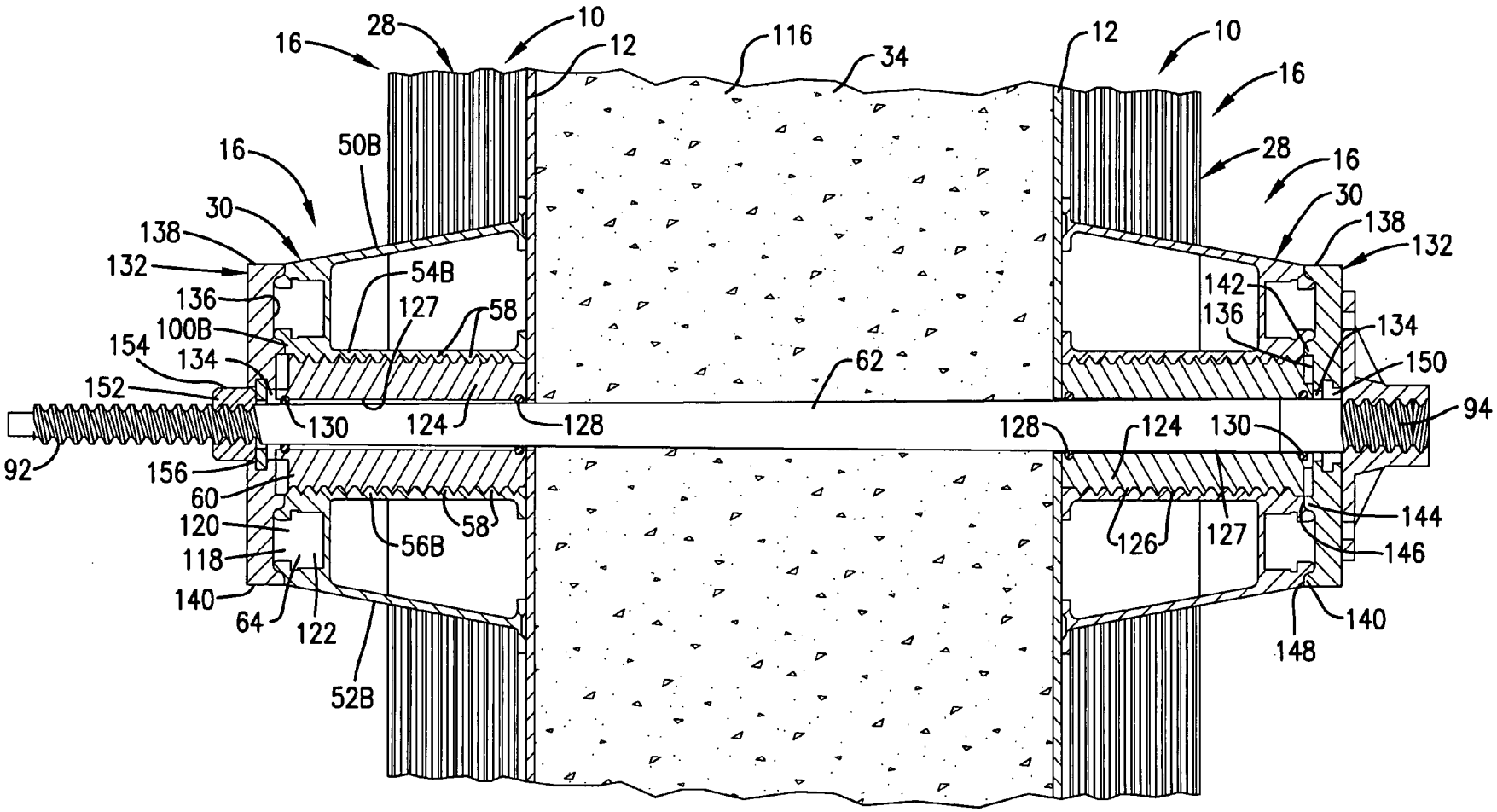
FIG. 4 is a fragmentary vertical cross-sectional view of the horizontal channel shown in FIG. 2 wherein the channel is configured to include rearwardly facing bolt slots for receiving bolt heads in addition to the threaded slots and wherein gasketed sleeves are threaded into the threaded slots for receiving a tapered tie rod.
Figure 5:
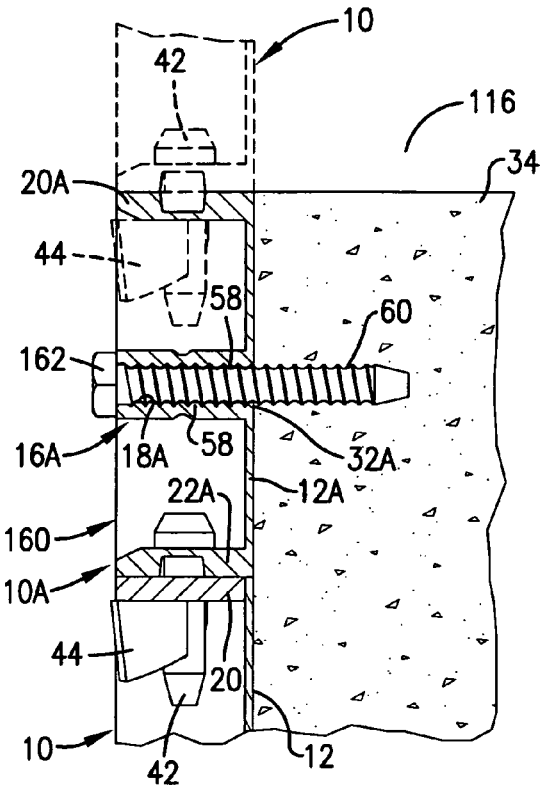
FIG. 5 is a fragmentary vertical cross-sectional view of a second embodiment of the forming panel configured as a cap form coupled atop another forming panel for use in pouring successive superposed wall sections and wherein an anchor bolt is threaded into the threaded slot of the cap form forming panel and passes through a hole in the face panel, the anchor bolt being anchored in the poured concrete.

FIGS. 2, 3 and 4 illustrate examples of how a threaded tie rod 62 may pass through opposite forming panels 10 and be held in place. A filler insert 66 is provided which includes a bushing 68, a U-shaped backing 70 and a pair of longitudinally spaced, U-shaped brackets 72 and 74. The U-shaped brackets 72 and 74 are welded or otherwise secured to the U-shaped backing so that the legs of the backing extend opposite to the legs of the brackets 72 and 74 and the bights of each are back-to-back, with the bushing 68 coupled to the backing 70 so that the bushing 68 resides in the space 76 between the brackets 72 and 74. The bushing 68 is preferably substantially tubular having a cylindrical outer surface and a passage 69 therethrough sized complementally to closely fit around a tie rod 62.

The bushing includes an internal groove into which an O-ring 78 snap fits for sealing around a tie rod 62, and an outer groove to receive therein a sealing ring 80. When inserted into the threaded slot 18, the sealing ring 80 is positioned proximate the hole 32 in the face plate 12 to aid in sealing around the tie rod 62 and inhibiting the migration of water or fine particles of cement past the hole 32 and around the tie rod 62.

The threaded member 60 may be an externally threaded retaining ring 82 having a threaded exterior 84 which is complemental in size and pitch to the threaded slot 18 and a substantially smooth interior surface 86 which is sized to receive the cylindrical outer surface of the bushing 68 therein. At least one end 88 of the retaining ring 82 has a slot 90 therein to facilitate turning the ring 82 so that it may be threaded into the threaded slot 18. The tie rod 62, having one threaded end 92 and another threaded end 94, may be secured in place by a nut 96 threaded onto one of the ends 92 and 94 which when tightened engages one of the filler inserts 66, and a plate 98 threaded onto the other of the ends 92 and 94 which when tightened engages the channel 16.

The channels 16 may be extruded in various configurations and reinforced. FIG. 3 illustrates one of the upright channels 28 of the embodiment shown in FIG. 1, wherein the channel walls 50 and 52 are formed separately from one another. Each of the channel walls 50 and 52 have respective wall surfaces 54 and 56 with ribs which are oriented to project into the threaded slot 18. In addition, each of the walls 50 and 52 of the upright channels 28 include rear walls 100 having an rearwardly facing surface 102 which is flat for abutting against, for example, plate 98, while the inwardly facing surface 104 is extruded with reinforcing corrugations 106. The respective wall surfaces 54 and 56 extend forwardly toward the face plate 12 to a front wall portion 108 having a rearwardly extending projection 110. A reinforcing bar 112, such as a steel bar, may be inserted into an elongated interior slot 114 formed by one of the corrugations 106 and the projection 110 to reinforce the channel 28 and thus the face plate 12.

In the combination shown in FIGS. 2 and 3, holes 32 are first cut or pierced into the face plates 12 in alignment with threaded slots 18 so that a tie rod 62 may pass through the holes as illustrated. The retaining ring 82 is then passed over the ends 92 and 94 of the tie rod 62 and threaded into the threaded slots 18 of each of the opposing forming panels 10. The filler insert 66 is then inserted into each of the threaded slots 18 as illustrated with the bushing 68 passing over the tie rod 62 and into the retaining ring 82 with the sealing ring 80 proximate to the hole 32. Plate 98 is then threaded onto one of the ends of the tie rod 62 until it abuts the rear wall 100 of one of the channels 16 and then nut 96 is threaded onto the other end of the tie rod 62 and tightened against the filler insert 66. The tie rod 62 thus passes through the gap 116 between the forming panels 10 into which concrete is to be poured, and widening of the gap 116 is resisted by the attachment of the tie rod 62 to the forming panels 10 as described.

The horizontal channel 30 of FIG. 4 is shown in FIGS. 1 and 2 and the use of a different coupling hardware is enabled by its configuration, although it may also use the filler insert 66 and retaining ring 82 as described with reference to FIGS. 2 and 3 above, and wherein like numbers are used to refer to like elements. The channel 16 is in this instance the horizontal channel 30 in the orientation of FIG. 1 like that shown in FIGS. 2 and 3, and thus provided as two separately extruded channel walls 50B and 52B each having respective wall surfaces 54B and 56B with ribs 58 as described above.

Each of the rear walls 100B, rather than having a relatively flat exterior surface, is provided with a longitudinally extending bolt slot 118 including a narrowed neck 120 defined by flanges and a recess 122 positioned forwardly and enlarged relative to the neck 120, such that the transverse dimension of the neck is less than the transverse dimension of the walls defining the recess adjacent thereto. The recess 122 is sized to receive the head of a bolt or the like therein when inserted in a gap in the neck, but the neck 120 is sized to prohibit the passage of a correctly sized bolt head therethrough. Preferably the bolt head would be rectangular or hexagonal so the sides of the bolt head engage the channel walls defining the recess to inhibit turning of the bolt within the bolt slot 118.

In addition, a substantially cylindrical, externally threaded collar 124 is provided which includes threads 126 on its exterior surface with a size and pitch complemental to permit threading of the collar onto the ribs 58 of the threaded slot 18. The threaded collar 124 has a substantially cylindrical bore 127 extending therethrough which receives sealing rings 128 and 130 in grooves adjacent respective first and second ends of the bore 126 as shown in FIG. 4, and may be provided with a square or hex head or a slot to facilitate receipt of a tool for rotating the collar 124 into the threaded slot 18.

The tie rod 62 may be held in place using caps 132 which have a central opening 134 through which the tie rod 62 may pass and which extends laterally to one margin of the cap. The caps 132 have a front face 136 which is complemental to the rear walls 100B, with outer rims 138 and 140 and inner ridges 142 and 144 which interfit into inner recesses 146 and outer recesses 148 of the rear walls 100B. In addition, the central openings 134 of the caps 132 have a flange slot 150 which extends to one margin of the caps 132. The central opening 134 including its flange slot 150 is sized to receive a nut 152 having a rectangular head 154 and rectangular flange 156, the head 154 being sized to slide along the central opening until aligned with the tie rod 62 and to resist rotation by engaging the portion of the cap 132 which is around the central opening 134 and the flange 156 resisting rotation by its engagement with the portion of the cap defining the flange slot 150.

In use, the collars 124 are first threaded into the threaded slots 18 of the channels 30, and then the caps 132 are placed over the rear walls 100B of the channels 30. The tie rod 62 is then inserted through the holes 32 in the face plates 12 of the opposing forming panels 10, through the cylindrical bore 126 of the collars 124, and through the central openings 134 of each of the caps 132. One end of the tie rod 62 is threaded into the nut 152. Plate 98 is then threaded over the other end of the tie rod 62 until it engages the cap 132. The front face 136 of the caps 132 resist rotation due to engagement of the outer recesses 146 and inner recesses 148 with the inner and outer recesses 146 and 148. The foregoing assembly is advantageous in that it requires only one person to install and seal the tie rod; the nut 152 resists rotation due to engagement with the portions of the caps, thereby permitting only one person to tighten the plate 98 on the other end of the tie rod.

FIGS. 5, 6, 7 and 8 illustrate a forming panel 10A having a channel 16A with a threaded slot 18A in accordance with the present invention used as a cap form 160 and adapted for coupling to the forming panel 10 as shown by the use of pins 42 and wedges 44. Like numbers are used to show like features as in the previous embodiment. The cap form 160 is typically used on construction sites to vertically extend the forming wall a short distance, such as for forming a parapet or the like. Additionally, the cap form 160 is useful in constructing vertical concrete walls of greater height, wherein the forming panel 10 is originally positioned below the cap form 160, then disconnected after the initial pour of concrete 34 is cured, and then recoupled to and above the cap form 160 in the position shown in the dotted lines in FIG. 5. The channel 16A is shown as a horizontal channel, although it is to be understood that the orientation of the channel 16A may vary on the forming panel or in use on the job site.

The use of the cap form 160 with the horizontal channel 16A having threaded slot 18A permits a threaded member 60 such as anchor bolt 162 to be threaded into the threaded slot 18A, whereupon it may pass through a hole 32A in the face plate 12A and into the space for receiving the concrete 34. The concrete 34 cures around the anchor bolt 162. After curing, the pins 42 and wedges 44 may be removed, the forming panel 10 disconnected, and then reattached on top of the cap form 160 as shown in dotted lines. A second pour of concrete 34 can then be made over the first pour shown in the drawing, and after curing, the anchor bolt 162 can be unscrewed and the pins 42 and wedges 44 removed so that the cap form 160 may be withdrawn for reuse.

Figure 6:
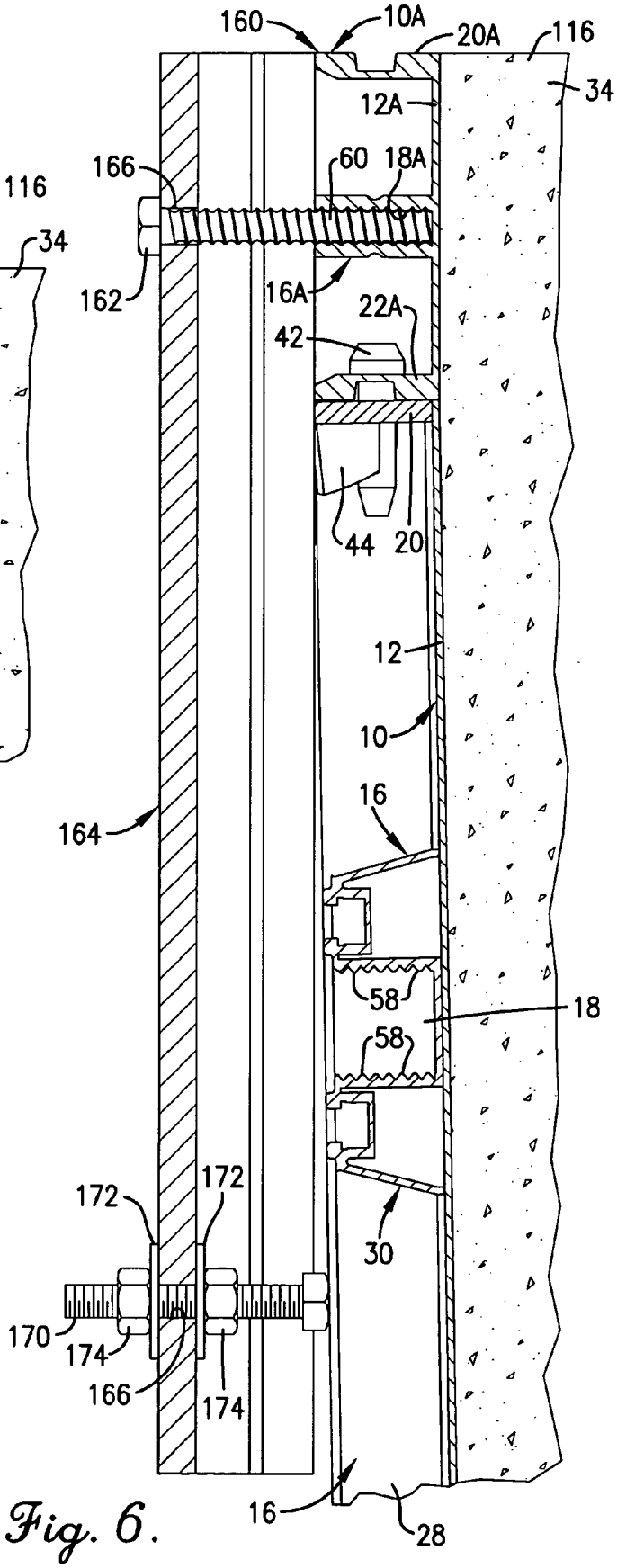
FIG. 6 is a fragmentary vertical cross-sectional view of the forming panel of FIG. 5 but wherein the bolt is threaded into the slot of the channel of the cap form forming panel without penetrating into the poured concrete and used for coupling a brace to the cap form forming panel.

As shown in FIG. 6, the threaded slot 18A of the forming panel 10A used as cap form 160 may also be used with a vertically oriented cap form brace 164. Cap form braces, as is known to those skilled in the art, are used to maintain alignment of the cap form with the lower forming panel 10. Cap form brace 164 is an elongated channel which is substantially U-shaped in cross section, as better seen in FIGS. 7 and 8. It may thus be appreciated that the face plate 12A aligned with the threaded slot 18A need not be penetrated.

FIG. 6 shows the anchor bolt passing through an opening 166 in the cap form brace 164 and threaded into the threaded slot 18A for holding the cap form brace 164 against the upper rail 20A and the lower rail 22A of the forming panel 10A. A conventional bolt 170, washer 172 and nut 174 may be used to pass through a lower opening 166 in the cap form brace and assist in aligning the cap form brace 164 and thus the cap form 160. The head of the bolt 170 is shown engaged with the rear wall 100 of one of the upright channels 16 of the forming panel 10.

Figure 7:
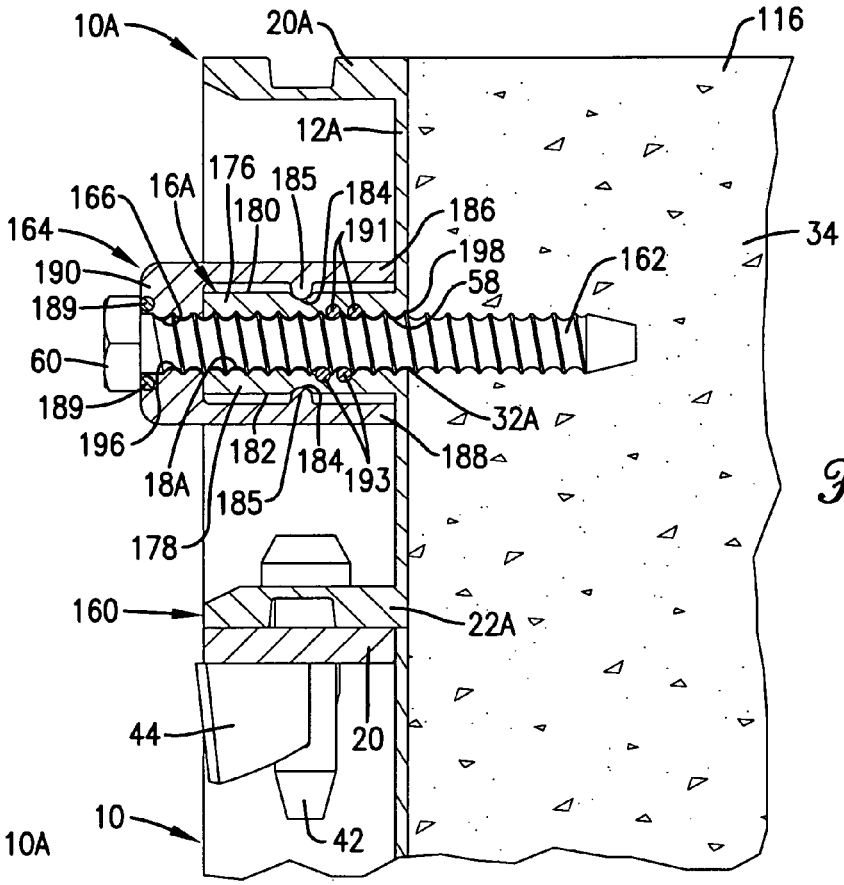
FIG. 7 is a fragmentary vertical cross-sectional view of the forming panel having a channel with threaded slot shown used in a cap form as shown in FIG. 5 wherein the channel is provided with opposed external grooves extending along the outside of the channel for coupling with a brace, the channel and brace having an anchor bolt which extends into the concrete.
Figure 8:
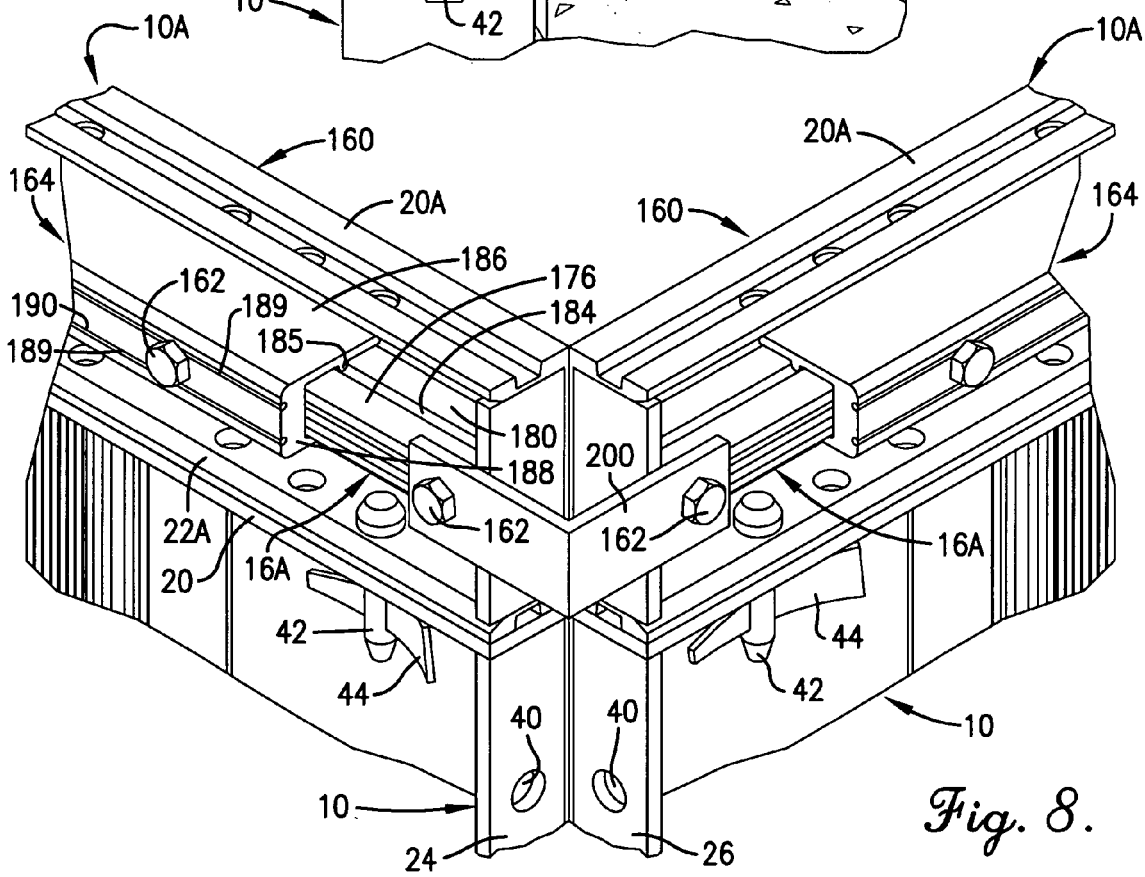
FIG. 8 is a fragmentary top perspective view showing two of the cap forms having channels of FIG. 7 coupled both to lower forming panels as shown in FIG. 1 and together and forming a corner of a forming wall.

As shown in FIGS. 7 and 8, the threaded slot 18A has further utility in maintaining horizontal alignment and providing added rigidity to the forming panel 10A, at which time cap form brace 164 may be oriented horizontally. The channel 16A as shown includes elongated upper wall 176 and opposed, parallel elongated lower wall 178 having the ribs 58 which providing threadable engagement for the anchor bolts 162 and other threaded members received in the threaded slot 18A.

The upper surface 180 of the upper wall 176 and the lower surface 182 of the lower wall 178 each have elongated exterior grooves 184. The cap form brace 164 includes elongated inwardly facing opposed detents 185 extending longitudinally along each of the substantially parallel, spaced-apart arms 186 and 188 of the cap form brace 164. The detents 185 are sized and positioned to be received in the grooves 184 when the cap form brace 164 is fully seated on the channel 16A as shown in FIGS. 7 and 8. In this position, the cap form brace 164 locks into the channel 16A.

A back wall 190 extends between and spaces apart the arms 192 and 194 and includes at least one and preferably a plurality of longitudinally spaced, internally threaded holes 196 for receiving a threaded member, such as anchor bolt 162 therethrough. The anchor bolt 162 threads into the threaded slot 18A of channel 16A and extends through an opening 198 in the face plate 12A and into the gap 116 into which the concrete 34 is poured, thereby securing the cap form 160 to the concrete 34 after it is cured with the cap form brace 164 connected to the channel 16A on the rear side of the forming panel 10A. A pair of elongated wear elements 189, preferably steel rods, are received in grooves in the exterior of back wall 190 and engageably underlie the head of bolt 162. Additional pairs of elongated wear elements 191 and 193, also preferably steel rods, are received in longitudinally extending grooves in the inner surfaces of upper and lower walls 176, 178 of channel 16A to bear against bolt 162 when bolt 162 is in threaded slot 18A.

The cap form brace 164 may extend longitudinally to couple with a plurality of forming panels 10A to provide both a connecting function as well as a reinforcing function for the forming wall. The threaded slot 18A has additional utility in permitting two adjacent forming walls of forming panels 10 and/or forming panels 10A to be connected at an angle by corner clips 200 by anchor bolts 162 threaded into the threaded slot 18A of forming panels 10A or alternatively of the threaded slot 18 of two adjacent horizontal channels 30 of two adjacent forming panels 10. A 90° angle corner clip is illustrated, but it is to be appreciated that a corner clip having an acute or obtuse angle may be provided to provide a corresponding corner angle between the forming panels.

Figure 9:
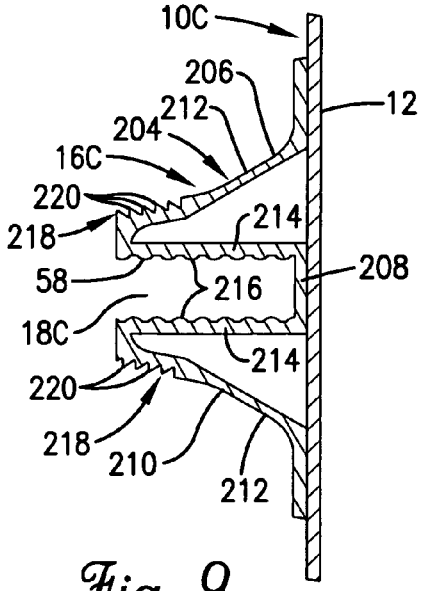
FIG. 9 is a fragmentary vertical elevational view of another alternate configuration of the forming panel having a channel with a threaded slot, wherein the channel has a plurality of external serrations as well as internal threads.

FIG. 9 illustrates a further embodiment of the forming panel hereof shown as forming panel 10C. The forming panel 10C is of similar construction to that of the forming panel 10, and like numbers are used to indicate like features. However, the forming panel 10C is provided with a channel 16C extending rearwardly from face plate 12 which comprises a continuously extruded wall 204 including an upper wall 206, a base 208, and a lower wall 210 and as so configured would be separately extruded and welded to the face plate 12 and/or the frame 14 so as if used with the forming panel 10 would be in a horizontal orientation between the continuous, full-length, upright channels 28.

Both the upper wall 206 and the lower wall 210 include an outer wall member 212 and an inner wall member 214. The inner wall members 214 of each of the upper wall 206 and lower wall 210 have opposed inner wall surfaces 216 which are provided with ribs 58 as described above for forming the threaded slot 18C which is the same as threaded slot 18. In addition, the outer wall member 212 of each of the upper wall 206 and the lower wall 210 include a roughened, preferably serrated outer surface 218 having a plurality of teeth 220 thereon. The teeth 220 are uniquely outwardly facing away from the threaded slot to provide a surface which facilitates the use of clamps or other attaching members, and further facilitates gaining a foothold when a worker is climbing up the back of the forming panel 10C.

Use of the forming panels 10, 10A and 10C will be well understood by those skilled in the art with reference to the drawings and description hereof. Similar forming panels are widely used and reused to construct various concrete structures such as foundations and the like. After forming walls are assembled of the various forming panels, such as forming panels 10, 10A or 10B by the use of pins, locking devices or the like, flowable concrete is poured against the front of the face plate and cured to hardness. The forming panels may then be removed. However, the forming panels 10, 10A and 10C facilitate the assembly and use of the forming panels by providing a direct connection of forming accessories by the use of threaded members such as anchor bolts, and further facilitate the connection of tie rods and the like at a variety of different locations through the face plate where the channels of the present invention provide reinforcement against damage to the forming panel. Damage, such as denting or deflection of the face plate, results in consequent degrading of the appearance of the concrete when cured thereagainst.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

The invention claimed is:

1. A fastening system for a forming panel for receiving thereagainst flowable cementatious material, said forming panel including a face panel having a front, cementatious-material receiving side and a rear side and a frame for supporting said face panel, said fastening system comprising:

an elongated member secured to at least one of said face panel and frame and having first and second spaced-apart substantially parallel rearwardly extending elongated side walls defining therebetween an elongated threaded slot, each of said side walls having a plurality of opposing ribs extending toward the other of said side walls and into said slot, the ribs of said first side wall being offset relative to the ribs of said second side wall to render said slot threaded;

a threaded member separable from said forming panel and threadably received in said elongated member for coupling a separate structural member to the forming panel;

a rod extending through said face panel; and a nut threadably connected to one end of said rod;

said threaded member including a collar surrounding said rod, said rod receiving said collar thereon and said collar being externally threaded and threaded into said elongated member.

2. A fastening system for a forming panel for receiving thereagainst flowable cementatious material, said forming panel including a face panel having a front, cementatious-material receiving side and a rear side and a frame for supporting said face panel, said fastening system comprising:

an elongated member secured to at least one of said face panel and frame and having first and second spaced-apart substantially parallel rearwardly extending elongated side walls defining therebetween an elongated threaded slot, each of said side walls having a plurality of opposing ribs extending toward the other of said side walls and into said slot, the ribs of said first side wall being offset relative to the ribs of said second side wall to render said slot threaded;

a threaded member separable from said forming panel and threadably received in said elongated member for coupling a separate structural member to the forming panel; and an elongated bearing member positioned in said slot and including a bushing, said bushing being coupled to said bearing member and said threaded member comprising an annular ring having a substantially smooth inner surface adjacent said bushing and a threaded outer surface for threadable engagement with said slot.

3. A fastening system for a forming panel for receiving thereagainst flowable cementatious material, said forming panel including a face panel having a front, cementatious-material receiving side and a rear side and a frame for supporting said face panel, said fastening system comprising:

an elongated member secured to at least one of said face panel and frame and having first and second spaced-apart substantially parallel rearwardly extending elongated side walls defining therebetween an elongated threaded slot, each of said side walls having a plurality of opposing ribs extending toward the other of said side walls and into said slot, the ribs of said first side wall being offset relative to the ribs of said second side wall to render said slot threaded;

a threaded member separable from said forming panel and threadably received in said elongated member for coupling a separate structural member to the forming panel;

a rod extending through said face panel; and a nut threadably connected to one end of said rod, said threaded member including a central bore having a sealing member therein for sealing engagement with said rod.

4. A fastening system for a forming panel for receiving thereagainst flowable cementatious material, said forming panel including a face panel having a front, cementatious-material receiving side and a rear side and a frame for supporting said face panel, said fastening system comprising:

an elongated member secured to at least one of said face panel and frame and having first and second spaced-apart substantially parallel rearwardly extending elongated side walls defining therebetween an elongated threaded slot, each of said side walls having a plurality of opposing ribs extending toward the other of said side walls and into said slot, the ribs of said first side wall being offset relative to the ribs of said second side wall to render said slot threaded;

a threaded member separable from said forming panel and threadably received in said elongated member for coupling a separate structural member to the forming panel;

a rod extending though said face panel;

a nut threadably connected to one end of said rod; and a cap cooperatively configured with said elongated member for resisting rotation of said cap relative to said forming panel, said nut including a bearing face thereon in engagement with said cap for resisting rotation of said nut relative to said cap.

* * * * *